US010000354B2

(12) United States Patent
Zou et al.

(10) Patent No.: US 10,000,354 B2
(45) Date of Patent: Jun. 19, 2018

(54) CONVEYANCE APPARATUS AND IMAGE RECORDING APPARATUS

(71) Applicant: BROTHER KOGYO KABUSHIKI KAISHA, Nagoya-shi, Aichi-ken (JP)

(72) Inventors: Peng Zou, Nagoya (JP); Kenji Samoto, Nagoya (JP); Yoshiyuki Washino, Gifu-Ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days. days.

(21) Appl. No.: 15/331,011

(22) Filed: Oct. 21, 2016

(65) Prior Publication Data

US 2017/0113894 A1 Apr. 27, 2017

(30) Foreign Application Priority Data

Oct. 23, 2015 (JP) ..... 2015-208809

(51) Int. Cl.

| | |
|---|---|
| ***B65H 1/00*** | (2006.01) |
| ***B65H 31/22*** | (2006.01) |
| ***B65H 1/26*** | (2006.01) |
| ***B65H 3/06*** | (2006.01) |
| ***B65H 31/20*** | (2006.01) |
| ***B65H 31/02*** | (2006.01) |

(52) U.S. Cl.

CPC ..... *B65H 31/22* (2013.01); *B65H 1/266* (2013.01); *B65H 3/0684* (2013.01); *B65H 31/02* (2013.01); *B65H 31/20* (2013.01); *B65H 2301/4212* (2013.01); *B65H 2402/46* (2013.01); *B65H 2405/11164* (2013.01); *B65H 2405/3321* (2013.01); *B65H 2405/3322* (2013.01); *B65H 2801/06* (2013.01)

(58) Field of Classification Search

CPC ..... B65H 2405/332; B65H 2405/35; B65H 2405/3521; B65H 2405/36; B65H 31/22; B65H 2405/3321; B65H 2405/3322; G03G 2221/1684

See application file for complete search history.

(56) References Cited

U.S. PATENT DOCUMENTS 8,469,352 B2 * 6/2013 Kunioka ..... B41J 13/103 271/164
8,573,584 B2 * 11/2013 Idehara ..... B65H 31/26 271/145
9,436,154 B2 * 9/2016 Hayayumi ..... G03G 21/1647

FOREIGN PATENT DOCUMENTS

JP 2007-112580 A 5/2007

* cited by examiner

*Primary Examiner* — Howard J Sanders
(74) *Attorney, Agent, or Firm* — Merchant & Gould P.C.

(57) ABSTRACT

There is provided a conveyance apparatus including a main body, a feed tray, and a discharge tray. The discharge tray includes a first projecting portion, and the main body includes a supporting portion, first and second contacting portions. With the installed discharge tray rotating by a first amount or more about a fulcrum in a direction for such a part of the discharge tray as positioned on one side in a second direction from the fulcrum to move away from the first contacting portion, the first projecting portion is positioned below the second contacting portion. The part of the installed discharge tray as positioned on the one side in the second direction from the fulcrum is lighter in weight than the part of the installed discharge tray as positioned on the other side in the second direction. The conveyance apparatus includes a regulating portion.

11 Claims, 10 Drawing Sheets

CONVEYANCE APPARATUS AND IMAGE RECORDING APPARATUS

CROSS REFERENCE TO RELATED APPLICATION

The present application claims priority from Japanese Patent Application No. 2015-208809 filed on Oct. 23, 2015, the disclosure of which is incorporated herein by reference in its entirety.

FIELD OF THE INVENTION

The present invention relates to a conveyance apparatus conveying a sheet, and an image recording apparatus including that conveyance apparatus to record image on the sheet.

DESCRIPTION OF THE RELATED ART

Many image recording apparatuses, such as printers and the like including a conveyance apparatus to internally convey a sheet, are provided with a feed tray to support the sheet fed to such an image recording apparatus, and a discharge tray to support the sheet discharged from the image recording apparatus. The feed tray and the discharge tray are respectively insertable to and removable from the image recording apparatus.

Conventionally, there is known an image formation apparatus configured to let the discharge tray come out from its main body by way of elastic deformation of a hinge arm supported by the main body as an external force at a predetermined value or above has acted thereon when the discharge tray revolves in one direction.

SUMMARY

However, in the publicly known image formation apparatus, the discharge tray is revolvable with the feed tray installed in the main body. Therefore, when a sheet is discharged to the discharge tray, if the discharge tray is in a revolved state, then the revolved discharge tray has a smaller outlet to discharge the sheet. As a result, the sheet being discharged is liable to get jammed.

Further, with respect to the publicly known image formation apparatus, because it is necessary to cause the external force at the predetermined value or above to act thereon for removing the discharge tray from the main body, time and effort are needed to remove the discharge tray from the main body.

The present invention is made in view of the above problem, and an object thereof is to provide a conveyance apparatus with which it is possible to reduce the possibility of jamming the sheet being discharged while it is easy to remove the discharge tray from the main body.

According to a first aspect of the present teaching, there is provided a conveyance apparatus conveying a sheet including:

a main body in which a conveyance route is defined to convey the sheet therethrough;

a feed tray which is installable into the main body at one side in a first direction through an opening formed in the main body, which is removable from the main body at the other side in the first direction, and which is configured to support the sheet to be fed to the conveyance route; and a discharge tray which is installable into the main body from one side in a second direction through the opening, which is removable from the main body from the other side in the second direction, and which is provided, when installed in the main body, above the feed tray installed in the main body to support the sheet discharged from the conveyance route, wherein the discharge tray includes a first projecting portion projecting upward;

wherein the main body includes:

a supporting portion provided on the other side in the second direction from the first projecting portion of the installed discharge tray to support the discharge tray from below, a first contacting portion provided on the one side in the second direction from the first projecting portion of the installed discharge tray to contact with the installed discharge tray from above, and a second contacting portion provided on the other side in the second direction from the first projecting portion of the installed discharge tray to contact with the first projecting portion under a condition that the discharge tray is installed or under a condition that the installed discharge tray is moved toward the other side in the second direction;

wherein under a condition that the installed discharge tray is rotated by a first amount or more about a fulcrum provided in the supporting portion so that a part of the discharge tray as positioned on the one side in the second direction from the fulcrum is moved away from the first contacting portion, the first projecting portion is positioned below the second contacting portion;

wherein the part of the installed discharge tray as positioned on the one side in the second direction from the fulcrum is lighter in weight than the part of the installed discharge tray as positioned on the other side in the second direction from the fulcrum; and wherein the conveyance apparatus includes a regulating portion to regulate the installed discharge tray from rotating by the first amount or more under a condition that the feed tray is positioned inside the main body.

Here, the inserting at the one side in the first direction as well as at the one side in the second direction and the removing at the other side in the first direction as well as at the other side in the second direction include the inserting at the one side in a direction inclined to the first direction as well as at the one side in a direction inclined to the second direction and the removing at the other side in a direction inclined to the first direction as well as at the other side in a direction inclined to the second direction. That is, inserting the discharge tray or the feed tray at the one side in the first direction or at the one side in the second direction and removing the same at the other side in the first direction or at the other side in the second direction include inserting and removing the discharge tray or the feed tray to and from the main body with the discharge tray or the feed tray revolved by a predetermined amount as will be described later on.

The first contacting portion is in contact with the installed discharge tray from above while the supporting portion supports the same from below.

If the installed discharge tray moves toward the other side in the second direction, then the first projecting portion comes to contact with the second contacting portion. By virtue of this, it is possible to regulate the discharge tray from moving toward the other side in the second direction.

Here, when the feed tray is not installed in the main body, if the discharge tray revolves or rotates about the fulcrum by the first amount or more in the direction away from the first contacting portion, then the first projecting portion will be positioned below the second contacting portion. As a result, even if the discharge tray moves toward the other side in the second direction, the first projecting portion still does not contact with the second contacting portion. In the above manner, when the feed tray is not installed in the main body, being revolved while being moved toward the other side in the second direction, the discharge tray is removed from the main body without being regulated by the second contacting portion.

Further, when the feed tray is positioned inside the main body, the regulating portion regulates the discharge tray from revolving by the first amount or more. Therefore, when the feed tray is positioned inside the main body, the second contacting portion regulates the discharge tray from being removed from the main body. Further, zero is also included in the value less than the first amount.

In the above manner, according to the above configuration, when the feed tray is positioned inside the main body, because the discharge tray is restricted in revolving to less than the first amount, it is possible to reduce the possibility of jamming the sheet being discharged to the discharge tray. Further, when the feed tray is not installed in the main body, because there is almost no need for an external force to remove the discharge tray from the main body, no extra time and effort are needed to remove the discharge tray from the main body.

According to a second aspect of the present teaching, there is provided a conveyance apparatus conveying a sheet including:

a main body in which a conveyance route through which the sheet is conveyed is formed; and a discharge tray which is installable into the main body in an inserting direction through an opening formed in the main body, which is removable from the main body in a removing direction opposite to the inserting direction, and which is configured to support the sheet discharged from the conveyance route, wherein the discharge tray includes a projecting portion projecting upward;

wherein the main body includes:

a supporting portion provided in the removing direction from the projecting portion of the discharge tray installed in the main body to support the discharge tray from below, a first contacting portion provided in the inserting direction from the projecting portion of the installed discharge tray to contact with the installed discharge tray from above, and a second contacting portion provided in the removing direction from the projecting portion of the installed discharge tray to contact with the projecting portion under a condition that the discharge tray is installed or under a condition that the installed discharge tray is moving in the removing direction;

wherein under a condition that the installed discharge tray is rotated by an amount or more about a fulcrum provided in the supporting portion so that a part of the discharge tray as positioned in the inserting direction from the fulcrum is moved away from the first contacting portion, the projecting portion is positioned below the second contacting portion; and wherein the part of the installed discharge tray as positioned in the inserting direction from the fulcrum is lighter in weight than the part of the installed discharge tray as positioned in the removing direction from the fulcrum.

Here, the inserting in the inserting direction and the removing in the removing direction include the inserting in a direction inclined to the inserting direction and the removing in a direction inclined to the removing direction. That is, inserting the discharge tray in the inserting direction and removing the same in the removing direction include inserting and removing the discharge tray to and from the main body with the discharge tray revolved by a predetermined amount as will be described later on.

According to the above configuration, the first contacting portion is in contact with the installed discharge tray from above while the supporting portion supports the same from below. If the installed discharge tray moves in the removing direction, then the projecting portion comes to contact with the second contacting portion. By virtue of this, it is possible to regulate the discharge tray from moving in the removing direction.

Further, according to the above configuration, the part of the installed discharge tray as positioned in the inserting direction from the fulcrum is lighter in weight than the part of the discharge tray in the removing direction from the fulcrum. Therefore, when the discharge tray is installed, the discharge tray is supported by the supporting portion due to its own weight while the first contacting portion is in contact from above with the same. That is, it is easy to install the discharge tray into the main body.

Further, according to the above configuration, no other members are present below the installed discharge tray from the projecting portion in the inserting direction and above the installed discharge tray from the projecting portion in the removing direction. Therefore, it is easy to revolve the installed discharge tray in such a direction as away from the first contacting portion.

According to the present teaching, it is possible to reduce the possibility of jamming the sheet being discharged while it is easy to remove the discharge tray from the main body.

DESCRIPTION OF THE EMBODIMENT

Figure 1:
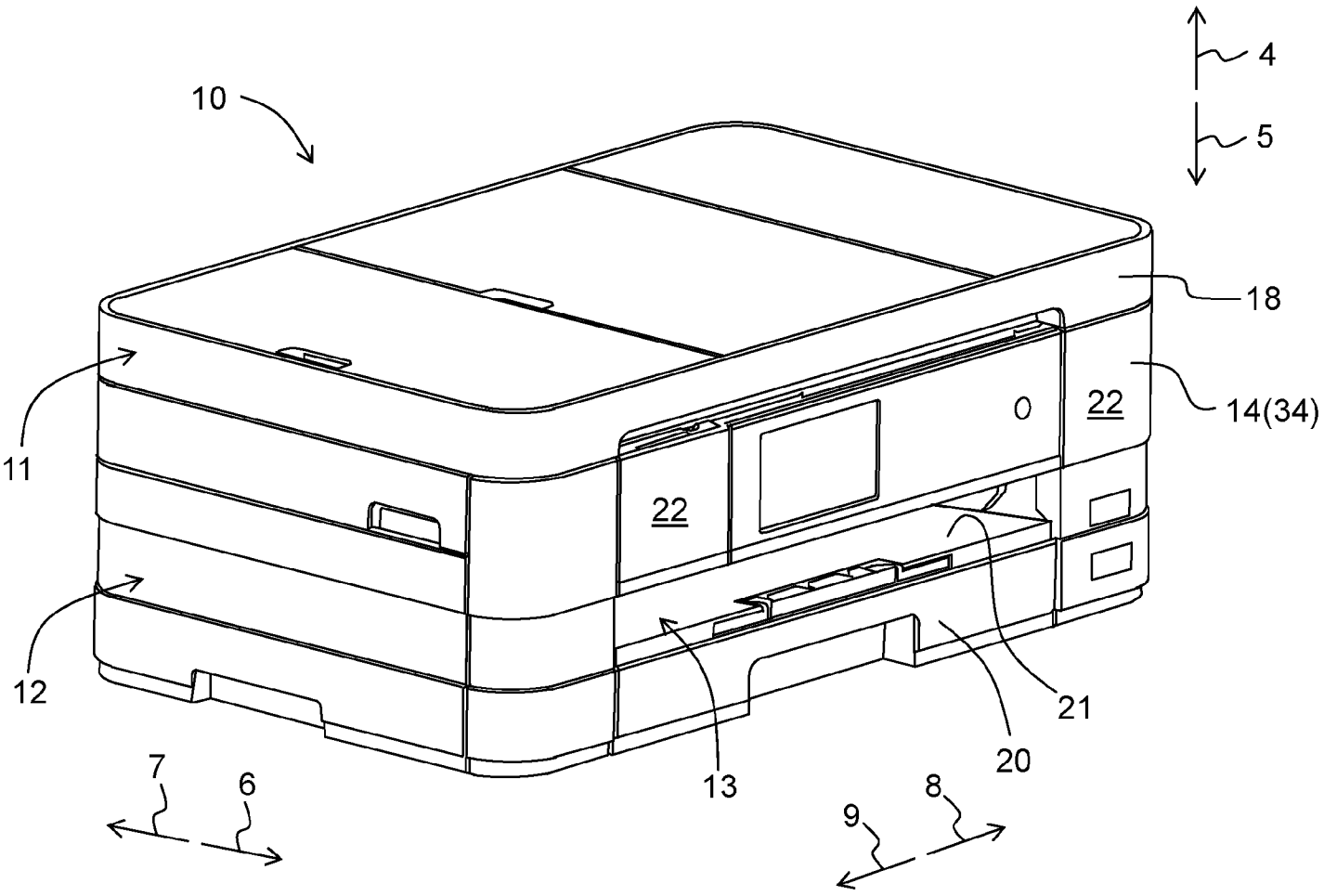
FIG. 1 is a perspective view of a multifunction printer 10.

An embodiment of the present teaching will be explained below. Further, it is needless to say that the embodiment explained below is merely an example of the present teaching and thus it is possible to change the embodiment as appropriate without departing from the true spirit and scope of the present teaching. Further, in the following explanation, an upward direction 4 and a downward direction 5 are defined with reference to a multifunction printer 10 placed in a usable state (the state of FIG. 1), a frontward direction 6 and a rearward direction 7 are defined with the side provided with an opening 13 as a front side 22, and a rightward direction 8 and a leftward direction 9 are defined with the multifunction printer 10 viewed in the rearward direction 7. The upward direction 4 and the downward direction 5 are opposite directions to each other. The frontward direction 6 and the rearward direction 7 are opposite directions to each other. The rightward direction 8 and the leftward direction 9 are opposite directions to each other. The upward direction 4, the frontward direction 6, and the rightward direction 8 are orthogonal to one another.

Further, in the following explanation of configurations of a feed tray 20, a discharge tray 21 and an extension tray 90, each direction is indicated with the feed tray 20 and the discharge tray 21 installed in a printer case 14 of the multifunction printer 10.

<Overall Configuration of the Multifunction Printer 10>

As shown in FIG. 1, the multifunction printer 10 is formed into an approximate cuboid. The multifunction printer 10 includes a scanner section 11 in its upper portion for an image sensor to read image recorded on a manuscript so as to acquire image data, and a printer section 12 (an example of the image recording apparatus) in its lower portion to record image on paper 15 (see FIG. 2) based on the above image data or the like.

While the scanner section 11 is configured as a so-called flat head scanner, detailed explanation of the internal configuration of the scanner section 11 will be omitted hereinbelow. The scanner section 11 has a scanner case 18 which is also an approximate cuboid.

Figure 2:
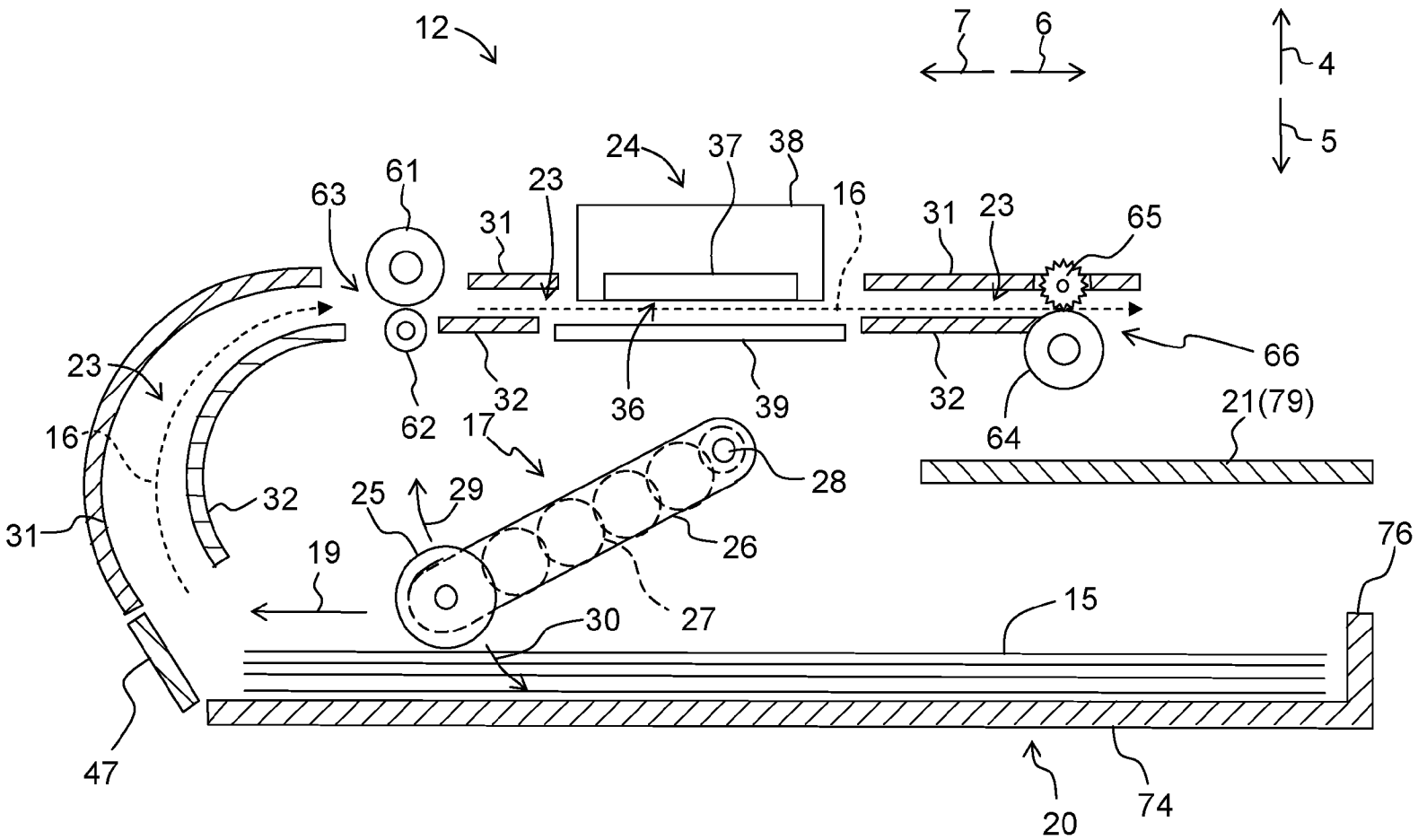
FIG. 2 is a vertical cross-sectional view schematically showing an internal structure of a printer section 12.

As shown in FIG. 2, the printer section 12 includes a conveyance apparatus and a recording unit 24. The conveyance apparatus includes the printer case 14 (an example of the main body of the present teaching; see FIG. 1), the feed tray 20, the discharge tray 21, the extension tray 90 (see FIG. 4), a feeding unit 17, a conveyance roller pair 63, and a discharge roller pair 66.

As shown in FIG. 1, the printer case 14 is an approximately cuboid case formed with the opening 13 in the front side 22 (an example of the first side). A conveyance route 23 is formed inside the printer case 14 and the paper 15 (an example of the sheet) is conveyed along the conveyance route 23.

The feed tray 20 supports the paper 15 to be fed to the conveyance route 23. The discharge tray 21 supports the paper 15 discharged from the conveyance route 23. The discharge tray 21 supports the extension tray 90 to be movable. The feeding unit 17 feeds the paper 15 supported by the feed tray 20 to the conveyance route 23. The conveyance roller pair 63 and the discharge roller pair 66 convey the paper 15 along the conveyance route 23. The recording unit 24 records image on the paper 15 conveyed through the conveyance route 23.

Figure 7:
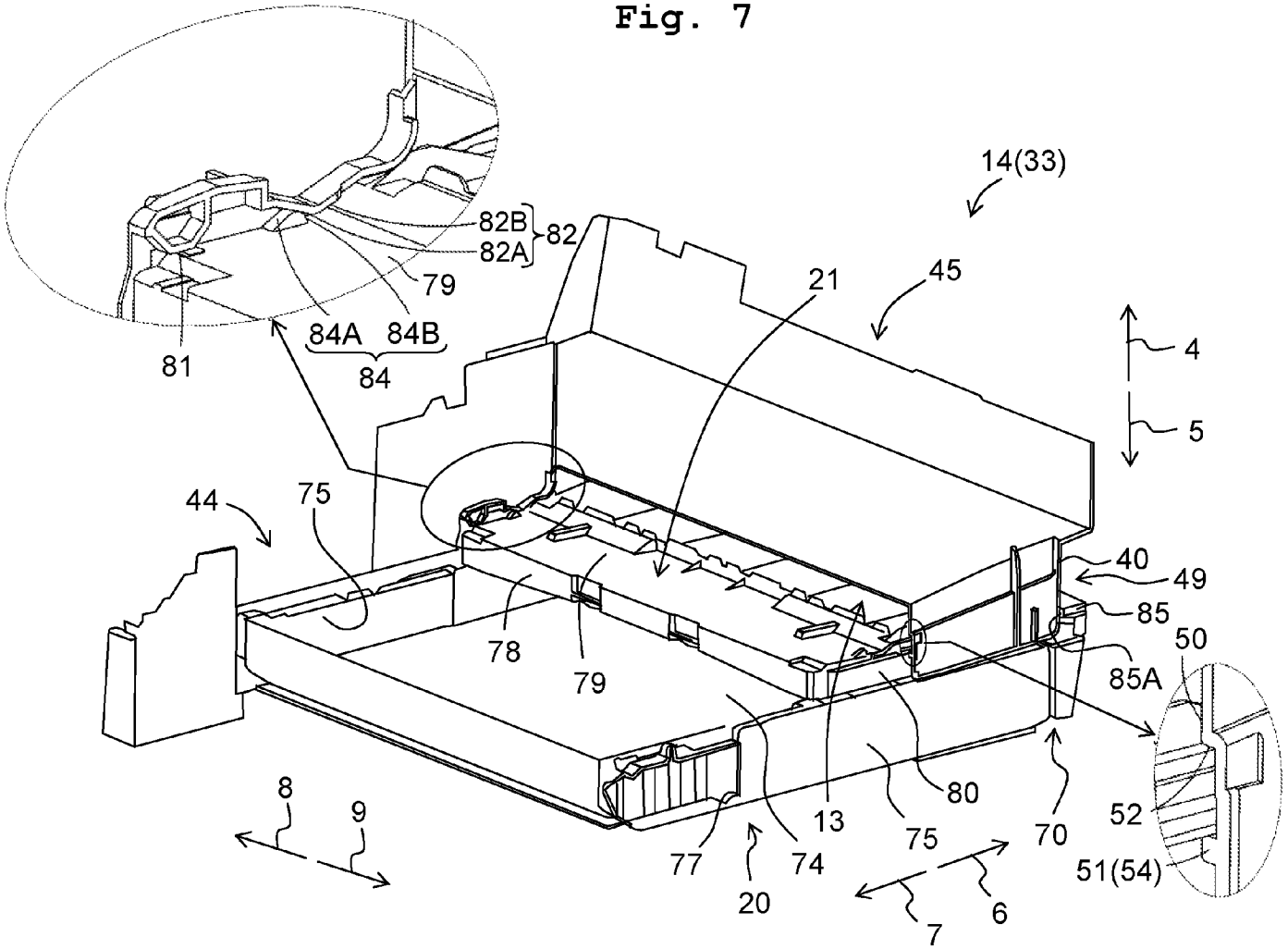
FIG. 7 is a perspective view of the lower case 33 of the printer case 14 installed with a feed tray 20 and the discharge tray 21.
Figure 9A:
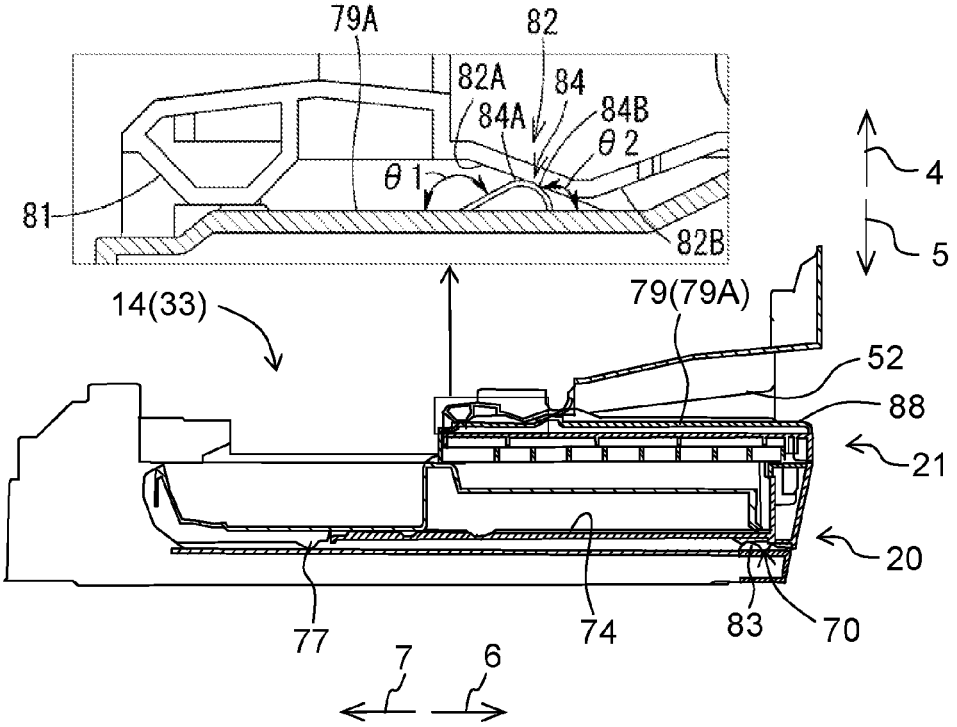
FIG. 9A is a vertical cross-sectional view of the lower case 33 of the printer case 14 installed with the feed tray 20 and the discharge tray 21.

The conveyance roller pair 63, the discharge roller pair 66, and the recording unit 24 are all arranged inside the printer case 14. The feed tray 20 and the discharge tray 21 are inserted into the printer case 14 through the opening 13 and installed in the printer case 14. The feed tray 20 and the discharge tray 21 shown in FIGS. 2, 7 and 9A are in the state of having been installed in the printer case 14. Further, the feed tray 20 and the discharge tray 21 can be removed from the printer case 14 through the opening 13.

<The Feeding Unit 17>

As shown in FIG. 2, the feeding unit 17 is arranged below the recording unit 24. The feeding unit 17 includes a feed roller 25, a feed arm 26, a driving force transmission mechanism 27, and a shaft 28. The feed roller 25 is supported to be rotatable at the leading end of the feed arm 26. The feed arm 26 revolves about the shaft 28 provided at its base end in directions indicated by arrows 29 and 30. By virtue of this, it is possible for the feed roller 25 to contact with and depart from the feed tray 20 or the paper 15 supported by the feed tray 20.

The driving force transmission mechanism 27 constructed of a plurality of engaged gears transmits a drive force from a feed motor (not shown) to the feed roller 25 to rotate the same. By virtue of this, among the sheets of the paper 15 supported on a bottom plate 74 of the feed tray 20, the uppermost sheet of the paper 15 in contact with the feed roller 25 is conveyed in the rearward direction 7. That conveyed sheet of the paper 15 is guided by an inclined plate 47 (see FIG. 2) and thereby fed to the conveyance route 23. Further, the driving force transmission mechanism 27 is not limited to the configuration of a plurality of engaged gears but may be, for example, a belt stretched between the shaft 28 and the shaft of the feed roller 25.

<The Conveyance Route 23>

As shown in FIG. 2, with a rear end portion of the installed feed tray 20 as the base point, the conveyance route 23 extends in the frontward direction 6 up to the discharge tray 21 after extending in the upward direction 4 while U-turning from the rearward direction 7 to the frontward direction 6. The conveyance route 23 is constructed from a first guide member 31 and a second guide member 32 facing each other across a predetermined interspace. The paper 15 is fed from the feed tray 20 to the conveyance route 23 and then conveyed through the conveyance route 23 in a conveyance direction 16 indicated by the dashed arrow in FIG. 2.

<The Conveyance Roller Pair 63 and the Discharge Roller Pair 66>

As shown in FIG. 2, on the upstream side from the recording unit 24 along the conveyance route 23 in the conveyance direction 16, there is provided the conveyance roller pair 63 constructed of a conveyance roller 61 and a pinch roller 62. The pinch roller 62 is pressed against the roller surface of the conveyance roller 61 by an elastic member (not shown) such as a spring or the like. On the downstream side from the recording unit 24 along the conveyance route 23 in the conveyance direction 16, there is provided the discharge roller pair 66 and constructed of a discharge roller 64 (an example of the roller) and a spur 65. The spur 65 is pressed against the roller surface of the discharge roller 64 by another elastic member (not shown) such as a spring or the like. Each of the conveyance roller 61 and the discharge roller 64 is rotated by a drive force transmitted thereto from a conveyance motor (not shown) to convey the paper 15 in the conveyance direction 16 while nipping the same between itself and the pinch roller 62 or the spur 65.

<The Recording Unit 24>

As shown in FIG. 2, the recording unit 24 is arranged above the conveyance route 23. The recording unit 24 includes a recording head 37 provided in a position facing the conveyance route 23, and a carriage 38 on which the recording head 37 is mounted. In the recording head 37, a plurality of nozzles 36 are formed to jet ink supplied from an ink cartridge (not shown) toward the conveyance route 23. The carriage 38 is configured to be movable in the rightward direction 8 and the leftward direction 9. Ink droplets are jetted from the nozzles 36 toward a platen 39 arranged below the conveyance route 23 to face the recording head 37 while the carriage 38 is moving. The platen 39 is a member adapted to support the paper 15. Image is recorded on the paper 15 by jetting the ink droplets from the nozzles 36 with the paper 15 being supported on the platen 39. Further, in this embodiment, the ink jet recording method is adopted for the recording unit 24 to record the image on the paper 15. Without being limited to this, however, for example the electrographic recording method or the like may be adopted.

<The Printer Case 14>

The printer case 14 is constructed, mainly, of a lower case 33 (see FIG. 6) forming the lower portion of the printer section 12, an upper case (not shown) provided above the lower case 33, and a cover 34 (see FIG. 1) covering the outsides of the lower case 33 and the upper case.

Figure 6:
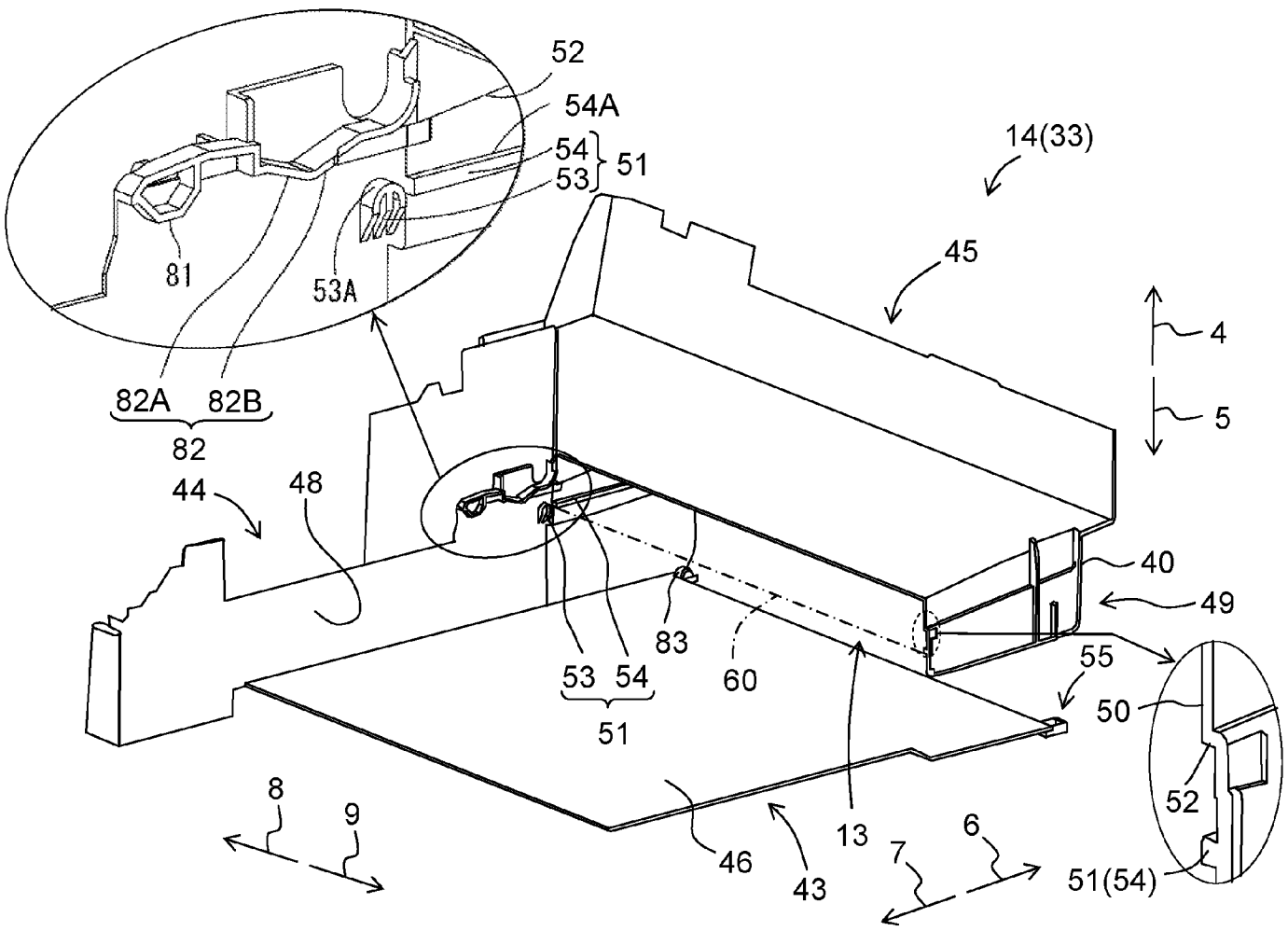
FIG. 6 is a perspective view of a lower case 33 of a printer case 14.

As shown in FIG. 6, the lower case 33 is constructed from a bottom portion 43, a right portion 44, a left portion 49, and an upper portion 45. Further, in FIG. 6, only part of the left portion 49 is shown while illustration of the rest of the left portion 49 is omitted.

The bottom portion 43 includes a bottom plate 46 expanding in the frontward direction 6 and the rearward direction 7 as well as in the rightward direction 8 and the leftward direction 9, and the inclined plate 47 (see FIG. 2) projecting from the rear end of the bottom plate 46 in the upward direction 4 toward the rearward direction 7. Further, illustration of the inclined plate 47 is omitted in FIG. 6 to FIGS. 10A and 10B. The bottom plate 46 defines the lower side of the space into which the feed tray 20 and the discharge tray 21 are inserted. The bottom plate 46 supports the feed tray 20 inserted in the printer case 14. The inclined plate 47 shown in FIG. 2 guides the paper 15 conveyed in the rearward direction 7 by the feeding unit 17 from the feed tray 20 to the conveyance route 23.

The right portion 44 projects upward from the right end of the bottom portion 43. The right portion 44 includes a side surface 48 facing in the leftward direction 9. The side surface 48 defines the right side of the space into which the feed tray 20 and the discharge tray 21 are inserted.

The left portion 49 projects upward from the left end of the bottom portion 43. The left portion 49 includes a side surface 50 facing in the rightward direction 8. The side surface 50 defines the left side of the space into which the feed tray 20 and the discharge tray 21 are inserted.

The upper portion 45 is arranged to link an upper front portion of the right portion 44 and an upper front portion of the left portion 49. The upper portion 45 faces a front portion of the bottom portion 43 in the upward direction 4 and the downward direction 5. The upper portion 45 defines the upper side of the space into which the feed tray 20 and the discharge tray 21 are inserted.

Each of the side surfaces 48 and 50 is formed with a supporting portion 51, a regulating portion 52, a first contacting portion 81, and a second contacting portion 82. The supporting portions 51, the regulating portions 52, the first contacting portions 81, and the second contacting portions 82 project leftward from the side surface 48 and project rightward from the side surface 50, respectively. The supporting portions 51, the regulating portions 52, the first contacting portions 81, and the second contacting portions 82 are all formed above the installed feed tray 20.

The supporting portions 51 support the discharge tray 21 to be movable. Here, the word "movable" refers to being movable in the frontward direction 6 and the rearward direction 7, and being revolvable as will be described later on. The supporting portion 51 projecting from the side surface 48 supports a right end portion of the discharge tray 21 from below while the supporting portion 51 projecting from the side surface 50 supports a left end portion of the discharge tray 21 from below.

Each of the supporting portions 51 or the supporting portion 51 is formed from a projecting portion 53 and a rib portion 54. The projecting portion 53 has an upper surface 53A curved to be upwardly convex. The rib portion 54 is formed in front of the projecting portion 53. The rib portion 54 is provided to extend in the frontward direction 6 and the rearward direction 7. Further, the rib portion 54 may extend in a direction inclined with respect to a direction in the frontward direction 6 and the rearward direction 7. The rib portion 54 has an upper surface 54A which has almost the same height as the upper surface 53A of the projecting portion 53.

The regulating portion 52 regulates the discharge tray 21 from revolving in the direction indicated by the arrow 102 (see FIG. 8B) by contact with an aftermentioned rib 88 (see FIG. 3) of the discharge tray 21. The regulating portion 52 is a surface facing the upper surface 54A of the rib portion 54 in the upward direction 4 and the downward direction 5. The regulating portion 52 is inclined to the upward direction 4 toward the frontward direction 6.

The first contacting portions 81 regulate the rear end portion of the discharge tray 21 from moving upward along with the revolving of the installed discharge tray 21 in the direction of the arrow 102, by contact from above with a rear end portion of an upper surface 79A of the installed discharge tray 21. The first contacting portion 81 projecting from the side surface 48 comes to contact from above with a right end portion of the upper surface 79A of the installed discharge tray 21. The regulating portion 52 projecting from the side surface 50 comes to contact from above with a left end portion of the upper surface 79A of the installed discharge tray 21.

The first contacting portion 81 is formed in the rear of the projecting portion 53. The first contacting portion 81 is formed above the upper surfaces 53A and 54A.

The second contacting portion 82 is formed in the rear of the projecting portion 53 and in front of the first contacting portion 81. The second contacting portion 82 is formed above the upper surfaces 53A and 54A. The second contacting portion 82 includes a first inclined surface 82A inclined to the downward direction 5 toward the frontward direction 6, and a second inclined surface 82B linked with the front end of the first inclined surface 82A and inclined to the upward direction 4 toward the frontward direction 6. The lower end of the second contacting portion 82, that is, the border between the first inclined surface 82A and the second inclined surface 82B is positioned above the upper surface 79A of the installed discharge tray 21 and below the projecting end of an aftermentioned projecting portion 84 provided on the upper surface 79A of the discharge tray 21. By virtue of this, in the course of the discharge tray 21 being inserted into the printer case 14, the projecting portion 84 comes to contact from the front with the second inclined surface 82B. On the other hand, in the course of the discharge tray 21 being removed from the printer case 14, the projecting portion 84 comes to contact from the rear with the first inclined surface 82A.

The bottom plate 46 is provided with third contacting portions 83. The third contacting portions 83 are provided respectively in left and right portions of the front end of the bottom plate 46. In detail, the third contacting portions 83 are embedded respectively in recessed portions 55 formed in the left and right end portions of the front end of the bottom plate 46. Each of the third contacting portions 83 is formed of a material having a lower elastic modulus than the bottom plate 46. The third contacting portion 83 projects upward from the bottom plate 46. The upper surface of the bottom plate 46 is curved to be upwardly convex. In the course of the feed tray 20 being inserted into the printer case 14, a projecting portion 77 provided on the feed tray 20 comes to contact from the front with the third contacting portion 83. On the other hand, in the course of the feed tray 20 being removed from the printer case 14, the projecting portion 77 comes to contact from the rear with the third contacting portion 83.

Further, the third contacting portions 83 may be formed integrally with the bottom plate 46. Further, the second contacting portions 82 may be different members from the lower case 33 and be formed of a material having a lower elastic modulus than the lower case 33.

<The Feed Tray 20>

As shown in FIG. 7, the feed tray 20 includes the bottom plate 74 to support the paper 15, a pair of lateral plates 75 (an example of the regulating portion) provided to stand upward from the right end and the left end of the bottom plate 74, and a front plate 76 provided to stand upward from the front end of the bottom plate 74.

The pair of lateral plates 75 are each provided with the projecting portion 77 (an example of the second projecting portion). The projecting portions 77 are formed respectively in a lower portion of the right surface of the lateral plate 75 provided on the right end of the bottom plate 74 and in a lower portion of the left surface of the lateral plate 75 provided on the left end of the bottom plate 74. Each of the projecting portions 77 projects downward from that lower portion. In the course of the feed tray 20 being inserted into or removed from the printer case 14, the projecting portions 77 come to contact with the third contacting portions 83. Further, the projecting portions 77 are not limited to the positions shown in FIG. 7 with respect to the frontward direction 6 and the rearward direction 7. For example, the projecting portion 77 may be formed in a front end portion or a rear end portion of the lateral plate 75.

In front of the projecting portions 77, recessed portions 70 are formed respectively in the pair of lateral plates 75. The recessed portions 70 are concaved upward from the lower ends of the pair of lateral plates 75. The recessed portions 70 engage respectively with the third contacting portions 83 when the feed tray 20 is installed.

When the feed tray 20 is installed, the feed roller 25 of the feeding unit 17 (see FIG. 2) conveys the paper 15 supported by the bottom plate 74 in the rearward direction 7. Being guided by the inclined plate 47 of the printer case 14 (see FIG. 2), the conveyed paper 15 is fed to the conveyance route 23.

<The Discharge Tray 21>

Figure 3:
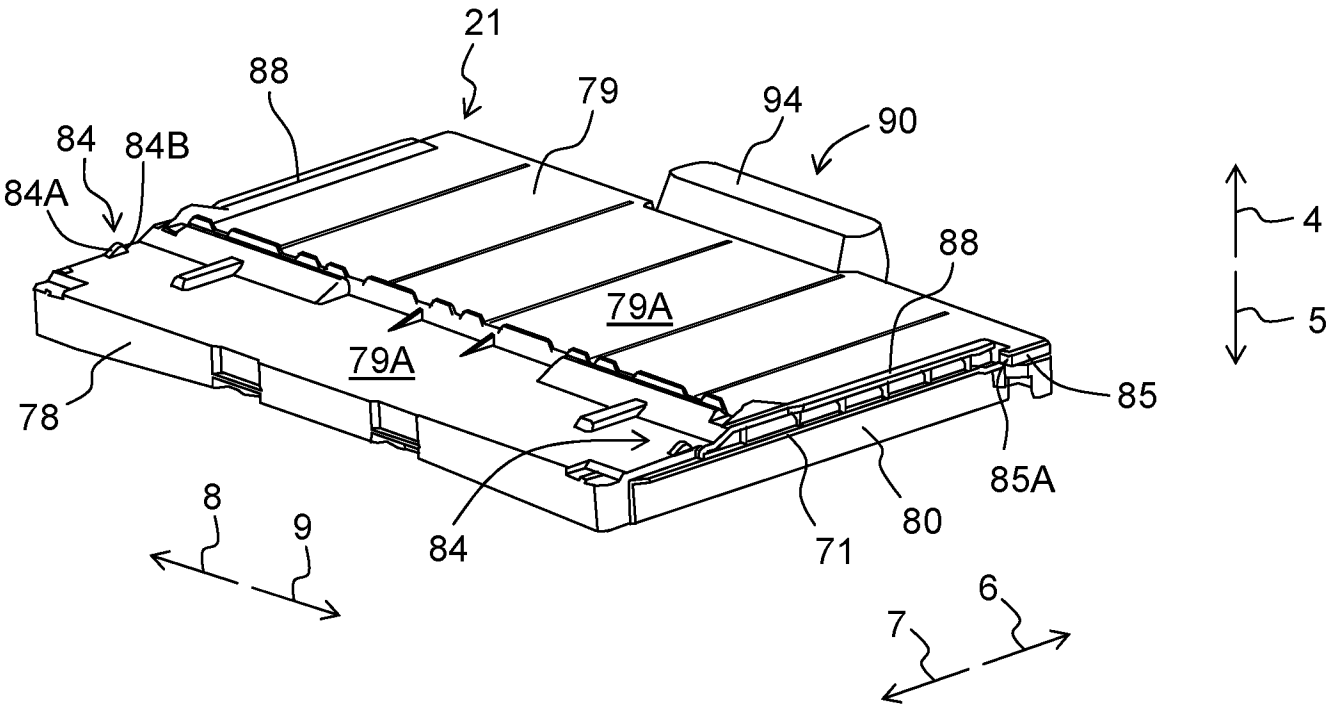
FIG. 3 is a perspective view of a discharge tray 21 observed from above, showing an extension tray 90 in a second position.

As shown in FIG. 3, the discharge tray 21 includes an upper plate 79 to support the paper 15 discharged from the conveyance route 23 of the printer case 14, a pair of lateral plates 80 extending downward respectively from the right end and the left end of the upper plate 79, and a rear plate 78 extending downward from the rear end of the upper plate 79.

On front end portions of the right end and the left end of the upper plate 79, a pair of projecting portions 85 are formed, respectively, to project rightward from the right end and to project leftward from the left end.

On the outward facing surfaces of the pair of lateral plates 80 (the right surface of the lateral plate 80 on the right and the left surface of the lateral plate 80 on the left), supported portions 71 are formed to project outward and extend in the frontward direction 6 and the rearward direction 7. With the supported portions 71 being supported by the supporting portions 51, the discharge tray 21 is movably supported by the printer case 14.

Figure 5:
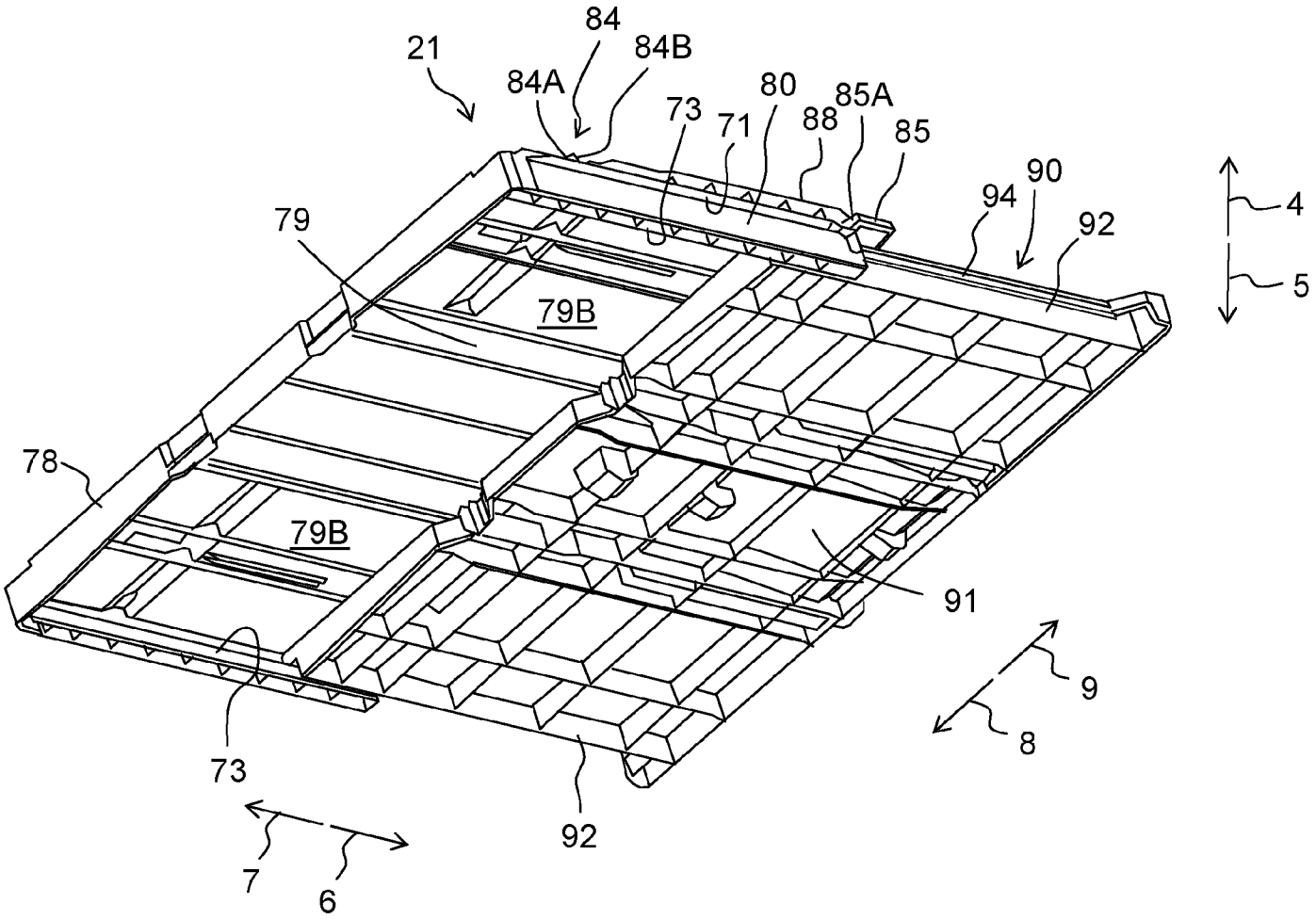
FIG. 5 is a perspective view of the discharge tray 21 observed from below, showing the extension tray 90 in the first position.

As shown in FIG. 5, on the inward facing surfaces of the pair of lateral plates 80 (the left surface of the lateral plate 80 on the right and the right surface of the lateral plate 80 on the left), rails 73 are formed to project inward and extend in the frontward direction 6 and the rearward direction 7. The rails 73 movably support the extension tray 90.

As shown in FIG. 3, the projecting portions 84 (an example of the first projecting portion) are formed to project in the upward direction 4, at the right end and the left end of the upper surface 79A of the upper plate 79. Each of the projecting portions 84 is formed in the rear of the central part of the discharge tray 21 according to the frontward direction 6 and the rearward direction 7. The projecting portion 84 includes a first inclined surface 84A inclined to the upward direction 4 toward the frontward direction 6, and a second inclined surface 84B linked with the front end of the first inclined surface 84A and inclined to the downward direction 5 toward the frontward direction 6. The first inclined surface 84A faces rearward while the second inclined surface 84B faces frontward. As shown in FIG. 9A, the angle θ1 formed between the upper surface 79A and the first inclined surface 84A is larger than the angle θ2 formed between the upper surface 79A and the second inclined surface 84B.

As shown in FIG. 3, in front of the projecting portions 84, ribs 88 are formed on the upper surface 79A of the upper plate 79 to project in the upward direction 4 and extend in the frontward direction 6 and the rearward direction 7. With the ribs 88 in contact with the regulating portions 52, the discharge tray 21 is regulated from revolving in the direction of the arrow 102 (see FIG. 8B).

The discharge tray 21 is insertable to and removable from the printer case 14 through the opening 13. When the discharge tray 21 is installed (in the state shown in FIG. 9A), the discharge tray 21 is supported by the supporting portions 51 from below in the front portion in front of the projecting portions 84. Further, in the rear portion in the rear of the projecting portions 84, the discharge tray 21 is not supported by any other members from below. By virtue of this, the installed discharge tray 21 is revolvable about the contact places with the projecting portions 53 constituting the rear ends of the supporting portions 51, in a direction for the front portion to move upward and for the rear portion to move rearward (in the direction of the arrow 102 shown in FIG. 8B). That is, a virtual line 60 (see FIG. 6), which passes through those contact places and extends in the rightward direction 8 and the leftward direction 9, serves as the revolving fulcrum for the discharge tray 21 (an example of the fulcrum). Further, while the virtual line 60 passes through the upper ends of the projecting portions 53 in FIG. 6, the virtual line 60 may pass through other parts than the upper ends of the projecting portions 53. This is because the contact places between the discharge tray 21 and the projecting portions 53 differ in position along with the revolving of the discharge tray 21.

Here, when the discharge tray 21 is installed, such a part of the discharge tray 21 as positioned in the rear of the abovementioned contact places is lighter in weight than the part of the discharge tray 21 positioned in front of the contact places. By virtue of this, due to its own weight, the front part of the discharge tray 21 comes to contact from above with the supporting portions 51, while the rear part is kept in the installed state, that is, in the state of contact from below with the first contacting portions 81.

Further, when viewing from above the printer case 14 installed with the discharge tray 21, the aforementioned revolving fulcrum overlaps with the area occupied by the discharge roller 64. In other words, the aforementioned revolving fulcrum is a line passing through the front end and the rear end of the discharge roller 64 when its position in the rightward direction 8 and the leftward direction 9 is between the right end and the left end of the discharge roller 64.

Further, as shown in FIG. 7, when the discharge tray 21 is installed, rearward facing surfaces 85A of the projecting portions 85 are in contact with front surfaces 40 of the right portion 44 and the left portion 49 of the printer case 14. By virtue of this, the installed discharge tray 21 is regulated from being inserted further rearward in the printer case 14.

Further, as shown in FIGS. 7 and 9A, the installed discharge tray 21 is positioned above the installed feed tray 20. Further, as shown in FIG. 2, the installed discharge tray 21 is positioned below the discharge roller 64. Further, when the discharge tray 21 is installed, the rear end of the discharge tray 21 is positioned in the rear of the discharge roller 64.

Further, as shown in FIG. 9A, when the discharge tray 21 is installed, the projecting portions 84 are positioned between the second contacting portions 82 and the first contacting portions 81 according to the frontward direction 6 and the rearward direction 7.

<The Extension Tray 90>

Figure 4:
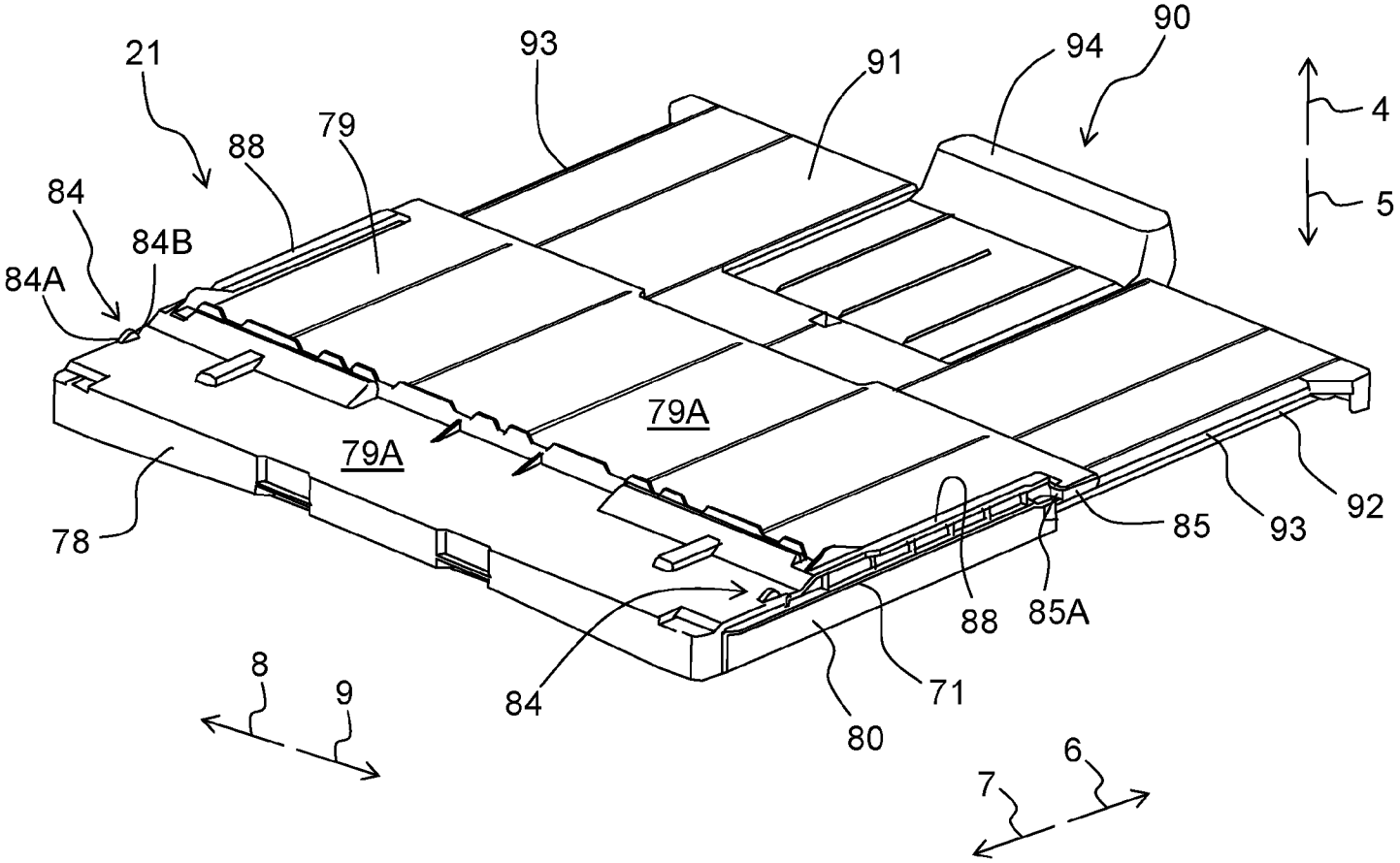
FIG. 4 is a perspective view of the discharge tray 21 observed from above, showing the extension tray 90 in a first position.

As shown in FIG. 5, the extension tray 90 is arranged between the pair of lateral plates 80 of the discharge tray 21. As shown in FIGS. 4 and 5, the extension tray 90 includes an upper plate 91, a pair of lateral plates 92 extending downward from the right end and the left end of the upper plate 91, and a grasping portion 94 projecting from the front end of the upper plate 91 for grasping in moving the extension tray 90.

In upper end portions on the outward facing surfaces of the pair of lateral plates 92 (the right surface of the lateral plate 92 on the right and the left surface of the lateral plate 92 on the left), extending portions 93 are formed to project outward and extend in the frontward direction 6 and the rearward direction 7. With the extending portions 93 being supported by the rails 73 of the pair of lateral plates 80 of the discharge tray 21, the extension tray 90 is supported by the discharge tray 21 to be movable in the frontward direction 6 and the rearward direction 7.

With the extending portion 93 being guided by the rails 73, the extension tray 90 is movable between a first position shown in FIGS. 4 and 5 and a second position shown in FIG. 3. The second position is in the rear of the first position in terms of the relative position to the discharge tray 21.

As shown in FIGS. 4 and 5, when the extension tray 90 is in the first position, the extension tray 90 is positioned with its rear end part below the upper plate 79 of the discharge tray 21 while the other part than the rear end part projects frontward from the front end of the discharge tray 21.

If a user grasps an exposed front end portion of the extension tray 90 in the first position (such as the grasping portion 94, for example) and pushes the same rearward, then the extension tray 90 moves from the first position to the second position. As shown in FIG. 3, when the extension tray 90 is in the second position, the most part of the extension tray 90 (the part other than the grasping portion 94 in this embodiment) is positioned below the upper plate 79 of the discharge tray 21. That is, when the discharge tray 21 is in the second position, the front end portion of the extension tray 90 is positioned closer to the discharge tray 21 than in the first position. If the user grasps the exposed grasping portion 94 of the extension tray 90 in the second position to draw the same frontward, then the extension tray 90 moves from the first position to the second position.

<Operation of Revolving the Discharge Tray 21 when the Extension Tray 90 is in the Second Position>

Hereinbelow, referring mainly to FIGS. 8A and 8B to FIGS. 10A and 10B, explanations will be made on operations of inserting and removing the discharge tray 21 and the feed tray 20 to and from the printer case 14. Further, in the following explanations, the extension tray 90 is in the second position.

Figure 8A:
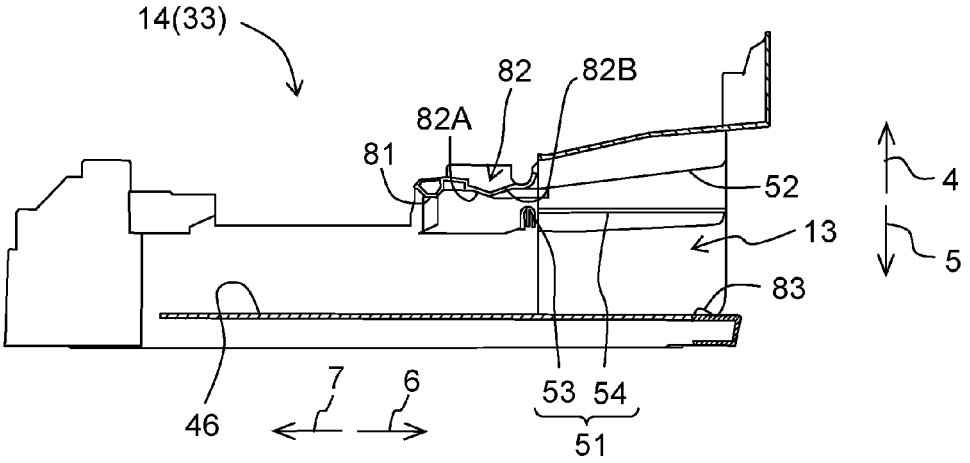
FIG. 8A is a vertical cross-sectional view of the lower case 33 of the printer case 14.

First, an explanation will be made on inserting the discharge tray 21 when the feed tray 20 is not installed (see FIG. 8A). In the state shown in FIG. 8A, when the discharge tray 21 is inserted, the user grasps the discharge tray 21 to insert the same such that the supported portions 71 may be positioned between the supporting portions 51 and the regulating portions 52.

On this occasion, the discharge tray 21 is insertable to the printer case 14 in the rearward direction 7 while the supported portions 71 are kept in contact with the supporting portions 51. Further, the discharge tray 21 is insertable to the printer case 14 in a direction 101 inclined at an angle θ3 to the rearward direction 7 (see FIG. 9B) while the ribs 88 are kept in contact with the regulating portions 52. Further, the discharge tray 21 is insertable in a direction inclined at an angle smaller than the angle θ3 to the rearward direction 7. That is, the discharge tray 21 should be inserted in the rearward direction 7 or in a direction inclined at an angle not larger than the angle θ3 to the rearward direction 7. Any of those directions is an example of the second direction at the one side or the inserting direction.

Figure 8B:
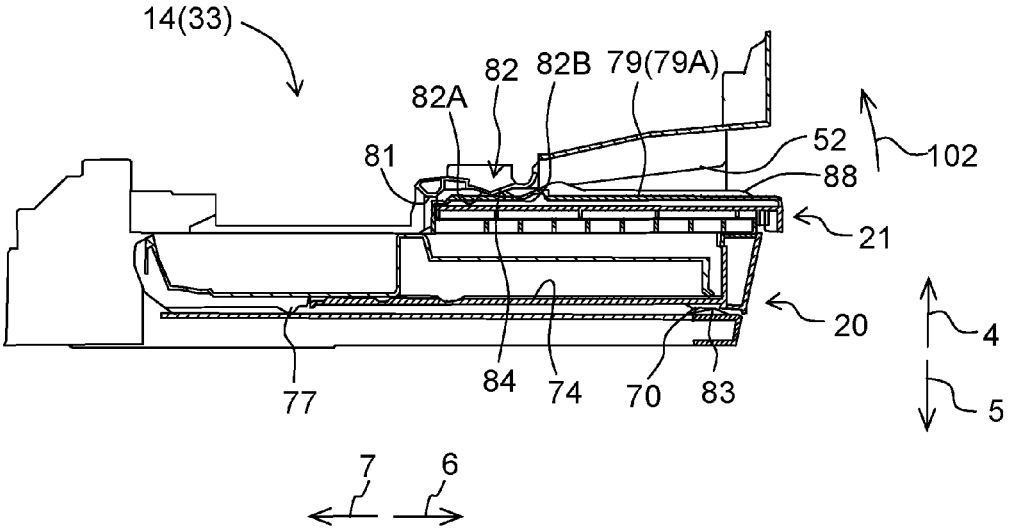
FIG. 8B is a vertical cross-sectional view of the lower case 33 of the printer case 14 installed with the feed tray 20, a projecting portion 84 of the discharge tray 21 being in contact with a second contacting portion 82 from the front.
Figure 9B:
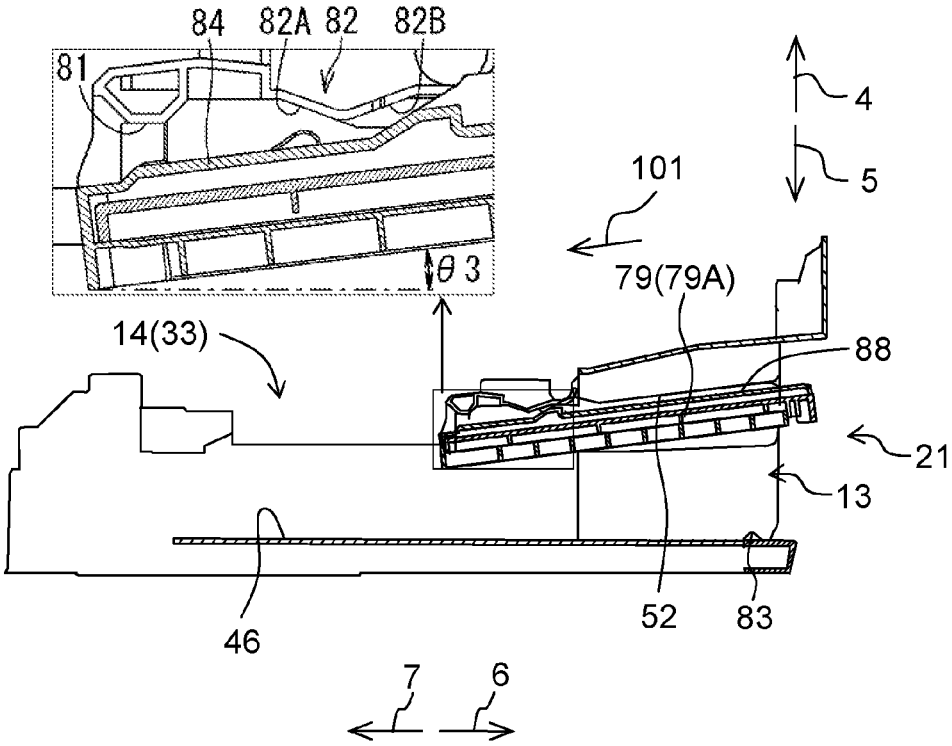
FIG. 9B is a vertical cross-sectional view of the lower case 33 of the printer case 14 with the revolved discharge tray 21.

When the discharge tray 21 is inserted into the printer case 14 in the rearward direction 7 while the supported portions 71 are kept in contact with the supporting portions 51, the projecting portions 84 come to contact from the front with the second contacting portions 82. By virtue of this, the discharge tray 21 is regulated from being inserted in the rearward direction 7. In this state, if the discharge tray 21 is revolved about the revolving fulcrum (the contact places between the discharge tray 21 and the projecting portions 53) in the direction of the arrow 102 (the direction in which the front end portion of the discharge tray 21 revolves upward while the rear end portion revolves downward), then the projecting portions 84 will be positioned below the second contacting portions 82 as shown in FIG. 9B. When the discharge tray 21 revolves in the direction of the arrow 102 from the position where the projecting portions 84 are in contact from the front with the second contacting portions 82 (the position as shown in FIG. 8B) to the position shown in FIG. 9B, the revolved amount of the discharge tray 21 is an example of the first amount.

By virtue of this, the discharge tray 21 is insertable all the way into the printer case 14. If the discharge tray 21 is inserted all the way into the printer case 14, then the surfaces 85A of the projecting portions 85 come to contact with the front surfaces 40 of the right portion 44 and the left portion 49 of the printer case 14 (see FIG. 7). By virtue of this, the discharge tray 21 is regulated from being inserted further. In this state, if the user releases his or her hand from the discharge tray 21, then the discharge tray 21 revolves, due to its own weight, about the revolving fulcrum in the opposite direction to that of the arrow 102. By virtue of this, the discharge tray 21 comes into the installed state as shown in FIG. 9A with the supported portions 71 in contact from above with the supporting portions 51 and the rear end portion of the upper surface 79A in contact from below with the first contacting portions 81. Of course, the user may revolve the discharge tray 21 in the opposite direction to that of the arrow 102 while keeping the grasp of the same. When the discharge tray 21 is installed, the projecting portions 84 are positioned in the rear of the second contacting portions 82.

Further, if the discharge tray 21 is inserted into the printer case 14 in the direction 101, then the projecting portions 84 are movable to the rear of the second contacting portions 82 without contact with the second contacting portions 82. In this case, therefore, the second contacting portions 82 do not regulate the discharge tray 21 from being further inserted in the course of insertion.

Next, an explanation will be made on inserting the discharge tray 21 when the feed tray 20 is installed or when the feed tray 20 is not sufficiently inserted as is installed but positioned partially inside the printer case 14. In this case, the discharge tray 21 is regulated from revolving in the direction of the arrow 102 (see FIG. 8B) because the discharge tray 21 comes to contact from above with the upper surfaces of the pair of lateral plates 75 of the feed tray 20. Hence, the feed tray 20 restricts the direction of inserting the discharge tray 21 to the rearward direction 7 or a direction slightly inclined to the rearward direction 7.

Therefore, in the course of inserting the discharge tray 21, as shown in FIG. 8B, even if the first inclined surfaces 84A of the projecting portions 84 come to contact from the front with the second contacting portions 82, because of the feed tray 20 arranged thereunder, the discharge tray 21 is still not revolvable to the extent that the projecting portions 84 may come below the second contacting portions 82. Hence, it is not possible to install the discharge tray 21 by being revolved in the direction of the arrow 102.

In this embodiment, however, the discharge tray 21 is inserted in the rearward direction 7 such that the first inclined surfaces 84A (see FIG. 9A) are pressed against the second contacting portions 82. By virtue of this, the projecting portions 84 undergo elastic deformation and thus move downward. Therefore, it is possible for the projecting portions 84 to get over the second contacting portions 82 and move to the rear of the second contacting portions 82. As a result, the discharge tray 21 comes into the installed state.

Next, an explanation will be made on removing the discharge tray 21 when the feed tray 20 is not installed. On this occasion, the direction of removing the discharge tray 21 is opposite to the direction of inserting the discharge tray 21 when the feed tray 20 is not installed. That is, the removing direction is the frontward direction 6 or a direction inclined at an angle not larger than θ3 to the frontward direction 6. Any of those directions is an example of the second direction at the other side or the removing direction.

When the discharge tray 21 is installed, the projecting portions 84 are in contact from the rear with the second contacting portions 82. In this state, if it is tried to move the discharge tray 21 in the frontward direction 6 with respect to the printer case 14, then the second contacting portions 82 will regulate such movement. In this state, if the discharge tray 21 is revolved in the direction of the arrow 102 (the direction in which such a rear part of the discharge tray 21 as relative to the revolving fulcrum departs from the first contacting portions 81), then the projecting portions 84 will be positioned below the second contacting portions 82 as shown in FIG. 9B. By virtue of this, the discharge tray 21 is movable frontward. By moving the discharge tray 21 frontward, the discharge tray 21 is removed from the printer case 14.

Next, an explanation will be made on removing the discharge tray 21 when the feed tray 20 is installed or when the feed tray 20 is not sufficiently inserted as is installed but positioned partially inside the printer case 14. In this case, because the discharge tray 21 is in contact from above with the feed tray 20, the discharge tray 21 is regulated from revolving in the direction of the arrow 102. In detail, if the installed discharge tray 21 is revolved about the revolving fulcrum in the direction of the arrow 102, then revolved by less than the first amount mentioned above, the discharge tray 21 will come to contact from above with the feed tray 20. Therefore, the direction of removing the discharge tray 21 on this occasion is opposite to the direction of inserting the discharge tray 21 when the feed tray 20 is positioned at least partially inside the printer case 14. That is, the removing direction is restricted to the frontward direction 6 or a direction slightly inclined to the frontward direction 6.

Hence, if it is tried to move the discharge tray 21 in the frontward direction 6 with respect to the printer case 14, then that movement is regulated by the second contacting portions 82. On this occasion, because of the feed tray 20 arranged thereunder, it is not possible for the discharge tray 21 to revolve to the extent that the projecting portions 84 may come below the second contacting portions 82. Further, as shown in FIG. 9A in this embodiment, the angle θ2 formed between the second inclined surfaces 84B and the upper surface 79A is set to be closer to 90 degrees than the angle θ1. Therefore, even if the second inclined surfaces 84B are pressed against the second contacting portions 82, the projecting portions 84 will not undergo elastic deformation to move downward. Hence, it is not possible for the projecting portions 84 to get over the second contacting portions 82 and thus move to the front of the second contacting portions 82. In the above manner, when the feed tray 20 is positioned at least partially inside the printer case 14, it is not possible to remove the discharge tray 21 from the printer case 14.

Next, an explanation will be made on inserting the feed tray 20. The feed tray 20 is inserted into the printer case 14 in the rearward direction 7 while being supported by the bottom plate 46. In so doing, the projecting portions 77 come to contact from the front with the third contacting portions 83. By virtue of this, the feed tray 20 is regulated from being inserted further. In this state, if the feed tray 20 is revolved about the rear end of the feed tray 20 in the direction of the arrow 103 (the direction in which the front end portion of the feed tray 20 revolves upward while the rear end portion revolves downward; see FIG. 10A), then the projecting portions 77 will be positioned above the third contacting portions 83 (see FIG. 10B). As the feed tray 20 revolves in the direction of the arrow 103 from the position shown in FIG. 10A to the position shown in FIG. 10B, the revolved amount of the feed tray 20 is an example of the second amount.

By the above operation, it is possible to insert the feed tray 20 in the rearward direction 7. That is, the direction of inserting the feed tray 20 is the rearward direction 7 or a direction in which the feed tray 20 revolved by not more than the second amount is inclined to the rearward direction 7. Any of those directions is an example of the first direction.

Thereafter, if the feed tray 20 is inserted into the printer case 14, then as shown in FIG. 9A, the recessed portions 70 and the third contacting portions 83 will be engaged. By virtue of this, the feed tray 20 is regulated from moving rearward further such that the feed tray 20 comes into the installed state. Further, with the projecting portions 77 positioned in the rear of the third contacting portions 83, the feed tray 20 is revolved in the opposite direction to the arrow 103 and returned to the state of being supported by the bottom plate 46.

Further, if the feed tray 20 is inserted when the discharge tray 21 is installed, then when the feed tray 20 revolves in the direction of the arrow 103, the pair of lateral plates 75 of the revolved feed tray 20 will press the pair of lateral plates 80 of the discharge tray 21 from below. By virtue of this, the discharge tray 21 revolves in the direction of the arrow 102. If the revolved feed tray 20 revolves in the opposite direction to the arrow 103, then the discharge tray 21 returns to the state of being supported by the supporting portions 51 due to its own weight.

Figure 10A:
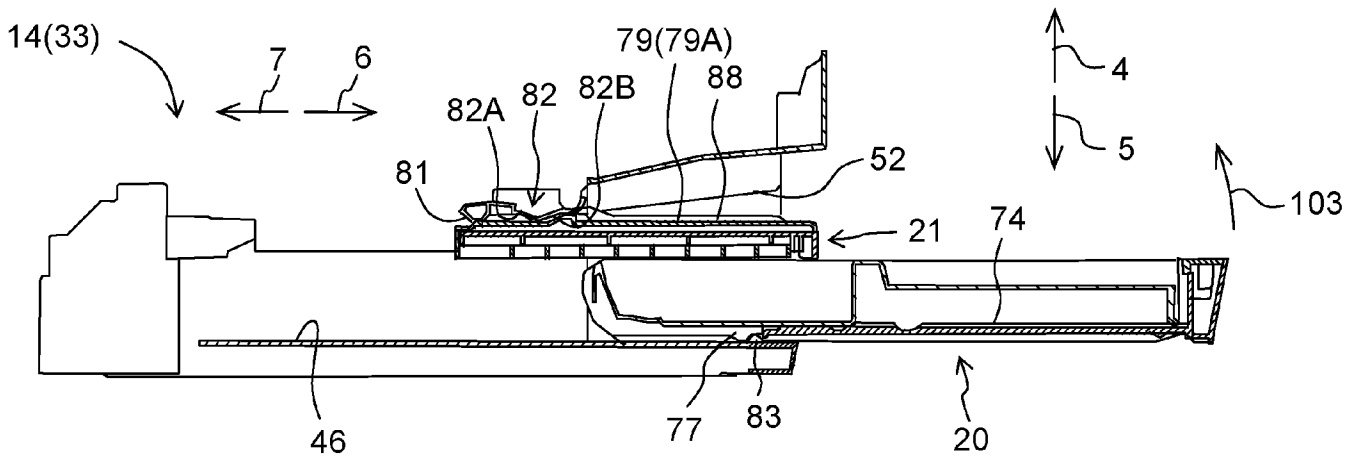
FIG. 10A is a vertical cross-sectional view of the lower case 33 of the printer case 14 installed with the discharge tray 21, a projecting portion 77 of the feed tray 20 being in contact with a third contacting portion 83 from the rear.
Figure 10B:
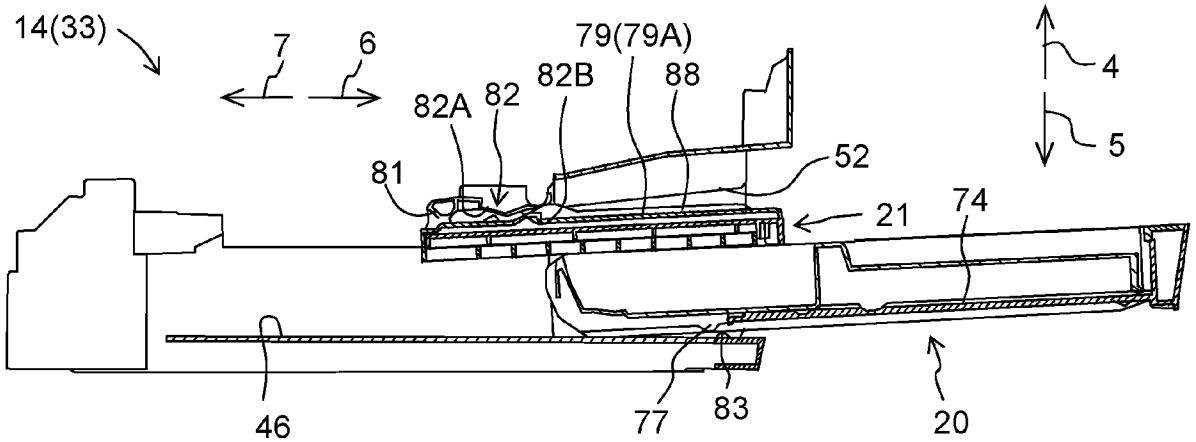
FIG. 10B is a vertical cross-sectional view of the lower case 33 of the printer case 14 with the discharge tray 21 being pressed to revolve by the revolved feed tray 20.

Next, an explanation will be made on removing the feed tray 20. The installed feed tray 20 (see FIG. 9A) is moved in the frontward direction 6 with respect to the printer case 14 while being supported by the bottom plate 46. In so doing, the projecting portions 77 come to contact from the rear with the third contacting portions 83 as shown in FIG. 10A. By virtue of this, the feed tray 20 is regulated from moving in the frontward direction 6. In this state, if the feed tray 20 is revolved by the second amount in the direction of the arrow 103, then the projecting portions 77 will be positioned above the third contacting portions 83 as shown in FIG. 10B. By virtue of this, the feed tray 20 is movable in the frontward direction 6. That is, the direction of removing the feed tray 20 is the frontward direction 6 or a direction for the feed tray 20 revolved by the second amount or less to be inclined to the frontward direction 6. Any of those directions is an example of the second direction.

Thereafter, the feed tray 20 is removed from the printer case 14 by moving the same in the frontward direction 6.

If the feed tray 20 is removed with the discharge tray 21 installed, then when the feed tray 20 revolves in the direction of the arrow 103, the pair of lateral plates 75 of the revolved feed tray 20 will press from below such parts of the pair of lateral plates 80 of the discharge tray 21 as positioned in front of the revolving fulcrum. By virtue of this, the discharge tray 21 revolves in the direction of the arrow 102. The revolved amount of the discharge tray 21 at this time is less than the necessary revolving amount of the discharge tray 21 for the projecting portions 84 to get over the second contacting portions 82 in inserting or removing the discharge tray 21. That is, the first amount is larger than the revolved amount of the discharge tray 21 in the direction of the arrow 102, pressed by the feed tray 20 revolved by the second amount in the direction of the arrow 103. Therefore, the second contacting portions 82 regulate the discharge tray 21 from moving in the frontward direction 6 along with the feed tray 20 moving in the frontward direction 6.

Further, in this embodiment, when the projecting portions 84 are in contact with the second contacting portions 82, the projecting portions 84 undergo elastic deformation and move downward. However, the projecting portions 84 may undergo elastic deformation and move upward or both the projecting portions 84 and the second contacting portions 82 may undergo elastic deformation.

Effects of the Embodiment

According to the above embodiment, the first contacting portions 81 contact with the installed discharge tray 21 from above while the supporting portions 51 support the same from below.

If the installed discharge tray 21 moves in the frontward direction 6, then the projecting portions 84 come to contact from the rear with the second contacting portions 82. By virtue of this, it is possible to regulate the discharge tray 21 from moving in the frontward direction 6.

Here, when the feed tray 20 is not installed in the printer case 14, if the discharge tray 21 revolves about the revolving fulcrum by the first amount or more in the direction of the arrow 102, that is, in the direction of moving away from the first contacting portions 81, then the projecting portions 84 will be positioned below the second contacting portions 82. As a result, even if the discharge tray 21 moves in the frontward direction 6, the projecting portions 84 still do not contact with the second contacting portions 82. In the above manner, when the feed tray 20 is not installed in the printer case 14, being revolved while being moved in the frontward direction 6, the discharge tray 21 is removed from the printer case 14 without being regulated by the second contacting portions 82.

Further, when the feed tray 20 is installed in the printer case 14, revolved by less than the first amount, the discharge tray 21 comes to contact with the feed tray 20. Hence, it is not possible for the discharge tray 21 to revolve by the first amount or more. Therefore, when the feed tray 20 is installed in the printer case 14, the second contacting portions 82 regulate the discharge tray 21 from being removed from the printer case 14.

In the above manner, according to the above embodiment, when the feed tray 20 is installed in the printer case 14, because the discharge tray 21 is restricted in revolving to less than the first amount, it is possible to reduce the possibility of jamming the paper 15 being discharged to the discharge tray 21. Further, when the feed tray 20 is not installed in the printer case 14, because there is almost no need for an external force to remove the discharge tray 21 from the printer case 14, no extra time and effort are needed to remove the discharge tray 21 from the printer case 14.

Further, when the discharge tray 21 is inserted to or removed from the printer case 14, as the projecting portions 84 are in contact with the second contacting portions 82, at least either the projecting portions 84 or the second contacting portions 82 undergo elastic deformation. By virtue of this, regardless of the presence of the second contacting portions 82, it is possible to insert or remove the discharge tray 21 to or from the printer case 14.

According to the above embodiment, the angle θ1 formed between the upper surface 79A of the discharge tray 21 and the first inclined surfaces 84A of the projecting portions 84 is larger than the angle θ2 formed between the upper surface 79A of the discharge tray 21 and the second inclined surfaces 84B of the projecting portions 84. Therefore, a first force needed to act on the projecting portions 84 for causing at least either the projecting portions 84 or the second contacting portions 82 to undergo elastic deformation when the discharge tray 21 is inserted into the printer case 14 is smaller than a second force needed to act on the projecting portions 84 for causing at least either the projecting portions 84 or the second contacting portions 82 to undergo elastic deformation when the discharge tray 21 is removed from the printer case 14. According to the above embodiment, therefore, with the feed tray 20 installed in the printer case 14, by adjusting the abovementioned two angles θ1 and θ2, it is possible to make it difficult to remove the discharge tray 21 from the printer case 14 but make it easy to insert the discharge tray 21 into the printer case 14.

Further, according to the above embodiment, by revolving the feed tray 20 by the second amount or more while moving the same in the frontward direction 6, it is possible for the projecting portions 77 to get over the third contacting portions 83. By virtue of this, it is possible to remove the feed tray 20 from the printer case 14. According to the above embodiment, even if the feed tray 20 is revolved for removing the feed tray 20 from the printer case 14, the discharge tray 21 is still restricted in revolving to less than the first amount. Therefore, when the feed tray 20 is removed from the printer case 14, it is possible to prevent the discharge tray 21 from being mistakenly removed together with the feed tray 20 from the printer case 14.

Further, according to the above embodiment, if the printer case 14 installed with the discharge tray 21 is viewed from above, then the revolving fulcrum overlaps with the area occupied by the discharge roller 64. It is possible in this configuration to have a larger amount of the revolving of the discharge tray 21 until the discharge tray 21 comes to contact with the discharge roller 64 than in a configuration for the revolving fulcrum not to overlap with the area occupied by the discharge roller 64 as viewed from above. By virtue of this, it is possible to reduce the possibility for the discharge tray 21 to contact with the discharge roller 64 when the discharge tray 21 is revolved.

Further, according to the above embodiment, even if the discharge tray 21 is about to move in the frontward direction 6 along with the extension tray 90 moving from the second position to the first position, that movement is still regulated by the second contacting portions 82. By virtue of this, it is possible to prevent the discharge tray 21 from being mistakenly removed from the printer case 14 along with the movement of the extension tray 90.

Modified Embodiments

In the above embodiment, when the discharge tray 21 is installed, the projecting portions 84 are in contact from the rear with the second contacting portions 82. However, the projecting portions 84 may be apart from the second contacting portions 82. In this case, in the course of moving the discharge tray 21 in the frontward direction 6 for removing the same, the projecting portions 84 come to contact from the rear with the second contacting portions 82.

In the above embodiment, when the feed tray 20 is installed, the projecting portions 77 are away from the third contacting portions 83 and, in the course of moving the feed tray 20 in the frontward direction 6 for removing the same, the projecting portions 77 come to contact from the rear with the third contacting portions 83. However, when the feed tray 20 is installed, the projecting portions 77 may be in contact from the rear with the third contacting portions 83.

A long hole, a notch, or the like may be provided in the upper surface 79A of the discharge tray 21 around the projecting portion 84. According to such a configuration, when the discharge tray 21 is inserted into the printer case 14, it is possible to reduce the force needed to act on the projecting portions 84 for moving the projecting portions 84 in the downward direction 5.

In the above embodiment, the feed tray 20 is installable below the discharge tray 21 installed in the printer section 12. However, the feed tray 20 may not be installable below the installed discharge tray 21. In this case, the operations of inserting and removing the discharge tray 21 to and from the printer case 14 are the same as when the feed tray 20 is not installed in the above embodiment.

According to the configuration of the feed tray 20 being not installable below the installed discharge tray 21, the following effect is achieved. The first contacting portions 81 are in contact from above with the installed discharge tray 21 and the supporting portions 51 support the same from below. If the installed discharge tray 21 moves in the frontward direction 6, then the second contacting portions 82 come to contact with the projecting portions 84. By virtue of this, it is possible to regulate the discharge tray 21 from moving in the frontward direction 6.

Further, such a part of the installed discharge tray 21 as positioned along the rearward direction 7 from the revolving fulcrum is lighter in weight than the part of the discharge tray 21 along the frontward direction 6 from the revolving fulcrum. Therefore, when the discharge tray 21 is installed, the discharge tray 21 is supported by the supporting portions 51 due to its own weight while the first contacting portions 81 are in contact from above with the same. That is, it is easy to install the discharge tray 21 into the printer case 14.

Further, no other members are present below the installed discharge tray 21 from the projecting portions 84 in the rearward direction 7 and above the installed discharge tray 21 from the projecting portions 84 in the frontward direction 6. Therefore, it is easy to revolve the installed discharge tray 21 in such a direction as away from the first contacting portions 81, that is, in the direction of the arrow 102.

In the above embodiment, the pair of lateral plates 75 of the feed tray 20 correspond to the regulating portion of the present teaching. However, the regulating portion of the present teaching is not limited to the pair of lateral plates 75. For example, such projecting portions as explained below may correspond to the regulating portion of the present teaching. These projecting portions project in the internal space of the opening 13 through openings (not shown) formed respectively on the lateral sides 48 and 50 of the lower case 33 (see FIG. 6), so as to support the rear end portion of the discharge tray 21 with the feed tray 20 installed. By virtue of this, the discharge tray 21 is regulated from revolving in the direction of the arrow 102 (see FIG. 8B). On the other hand, moving along with the feed tray 20 being removed, those projecting portions retreat from the internal space of the opening 13 so as not to support the rear end portion of the discharge tray 21. By virtue of this, as shown in FIG. 9B, the discharge tray 21 is allowed to revolve.

In the above embodiment, the conveyance apparatus is provided in the printer section 12 which is an example of the image recording apparatus. However, the conveyance apparatus may be provided in another portion than the printer section 12. For example, the conveyance apparatus may be provided in the scanner section 11. In this case, the feed tray 20 supports the manuscript paper with images thereon to be read by the scanner section 11. Further, the discharge tray 21 supports the discharged manuscript paper with the images thereon which have been read by the scanner section 11.

What is claimed is:

1. A conveyance apparatus conveying a sheet comprising:

a main body in which a conveyance route is defined to convey the sheet therethrough;

a feed tray which is installable into the main body in a first direction through an opening formed in the main body, which is removable from the main body in a first opposite direction opposite to the first direction, and which is configured to support the sheet to be fed to the conveyance route; and a discharge tray which is installable into the main body in a second direction through the opening, which is removable from the main body in a second opposite direction opposite to the second direction, and which is provided, when installed in the main body, above the feed tray installed in the main body to support the sheet discharged from the conveyance route, wherein the discharge tray includes a first projecting portion projecting upward;

wherein the main body includes:

a supporting portion located away from the first projecting portion of the installed discharge tray in the second opposite direction to support the discharge tray from below, a first contacting portion located away from the first projecting portion of the installed discharge tray in the second direction, wherein the first contacting portion is configured to come into contact with a part of the installed discharge tray that is positioned downstream of the first projecting portion in the second direction from above, and a second contacting portion located away from the first projecting portion of the installed discharge tray in the second opposite direction to contact with the first projecting portion under a condition that the discharge tray is installed or under a condition that the installed discharge tray is moved in the second opposite direction;

wherein under a condition that the installed discharge tray is rotated by a first amount or more about a fulcrum provided in the supporting portion so that a part of the discharge tray as positioned in the second opposite direction farther than the fulcrum is moved away from the first contacting portion, the first projecting portion is positioned below the second contacting portion;

wherein the part of the installed discharge tray as positioned in the second direction farther than the fulcrum is lighter in weight than the part of the installed discharge tray as positioned in the second opposite direction than the fulcrum; and wherein the conveyance apparatus includes a regulating portion to regulate the installed discharge tray from rotating by the first amount or more under a condition that the feed tray is positioned inside the main body.

2. The conveyance apparatus according to claim 1, wherein the regulating portion is provided on the feed tray.

3. The conveyance apparatus according to claim 1, wherein at least one of the first projecting portion and the second contacting portion is elastically deformable.

4. The conveyance apparatus according to claim 3, wherein an angle formed between an upper surface of the discharge tray and a surface of the first projecting portion facing in the second direction is larger than an angle formed between the upper surface and a surface of the first projecting portion facing in the second opposite direction.

5. The conveyance apparatus according to claim 1, wherein the feed tray includes a second projecting portion projecting downward;

wherein the main body includes a third contacting portion to contact with the second projecting portion under a condition that the feed tray is installed in the main body in the second direction;

wherein under a condition that the feed tray installed in the main body is rotated by a second amount about an end portion, in the first direction, of the feed tray so that an opposite end portion, in the first direction, of the feed tray is moved upward, the second projecting portion is positioned above the third contacting portion;

wherein under a condition that the rotating feed tray presses from below such a part of the discharge tray as positioned in the second opposite direction farther than the fulcrum, such a part of the discharge tray as positioned in the second direction farther than the fulcrum rotates in a direction away from the first contacting portion; and wherein the first amount is larger than the rotated amount of the discharge tray under a condition that the feed tray has rotated by the second amount.

6. The conveyance apparatus according to claim 1, further comprising a roller positioned above the installed discharge tray to convey the sheet conveyed thereto through the conveyance route and discharge the sheet to the discharge tray, wherein the end of the installed discharge tray in the second opposite direction is positioned in the second direction farther than the roller.

7. The conveyance apparatus according to claim 6, wherein when viewed from above, the fulcrum overlaps with an area occupied by the roller.

8. The conveyance apparatus according to claim 1, further comprising an extension tray supported by the discharge tray to be movable between a first position for a projecting end portion of the extension tray to project from the end of the discharge tray in the second opposite direction and a second position in which the projecting end portion is closer to the discharge tray than in the first position.

9. An image recording apparatus comprising:

the conveyance apparatus according to claim 1; and a recording unit configured to record an image on the sheet conveyed inside the main body.

10. A conveyance apparatus conveying a sheet comprising:

a main body in which a conveyance route through which the sheet is conveyed is formed; and a discharge tray which is installable into the main body in an inserting direction through an opening formed in the main body, which is removable from the main body in a removing direction opposite to the inserting direction, and which is configured to support the sheet discharged from the conveyance route, wherein the discharge tray includes a projecting portion projecting upward;

wherein the main body includes:

a supporting portion provided in the removing direction from the projecting portion of the discharge tray installed in the main body to support the discharge tray from below, a first contacting portion provided in the inserting direction from the projecting portion of the installed discharge tray to contact with the installed discharge tray from above, and a second contacting portion provided in the removing direction from the projecting portion of the installed discharge tray to contact with the projecting portion under a condition that the discharge tray is installed or under a condition that the installed discharge tray is moving in the removing direction;

wherein under a condition that the installed discharge tray is rotated by an amount or more about a fulcrum provided in the supporting portion so that a part of the discharge tray as positioned in the inserting direction from the fulcrum is moved away from the first contacting portion, the projecting portion is positioned below the second contacting portion; and wherein the part of the installed discharge tray as positioned in the inserting direction from the fulcrum is lighter in weight than the part of the installed discharge tray as positioned in the removing direction from the fulcrum.

11. An image recording apparatus comprising:

the conveyance apparatus according to claim 10; and a recording unit configured to record an image on the sheet conveyed inside the main body.

* * * * *